United States Patent [19]

Fransen et al.

[11] Patent Number: 4,962,716

[45] Date of Patent: Oct. 16, 1990

[54] FLOATING DOCK HAVING SHOCK-ABSORBING COUPLING

[75] Inventors: Sig T. Fransen, Estacada; Wayne K. Dye, Jr., Oregon City, both of Oreg.

[73] Assignee: Oregon Marine Floats, Inc., Oregon City, Oreg.

[21] Appl. No.: 347,022

[22] Filed: May 4, 1989

Related U.S. Application Data

[63] Continuation-in-part of Ser. No. 232,296, Aug. 15, 1988, Pat. No. 4,852,509.

[51] Int. Cl.[5] ..... B63B 35/38

[52] U.S. Cl. ..... 114/263; 114/266; 405/219

[58] Field of Search ..... 114/263, 266, 267, 264, 114/77 R; 405/218–221; 403/221, 224, 227; 14/27

[56] References Cited

U.S. PATENT DOCUMENTS

| | | | |
|---|---|---|---|
| 4,321,882 | 3/1982 | Sluys | 114/266 |
| 4,453,488 | 6/1984 | Watchorn | 114/266 |
| 4,697,539 | 10/1987 | Creed | 114/266 |

*Primary Examiner*—Joseph F. Peters, Jr.
*Assistant Examiner*—Edwin L. Swinehart
*Attorney, Agent, or Firm*—Chernoff, Vilhauer, McClung & Stenzel

[57] ABSTRACT

A multi-element floating dock has shock-absorbing flexible tieing elements which are installed as a unit without any manual adjustment being required to create a pretension in the shock-absorbing components. Elastomeric pads positioned in aligned cavities formed in the edges of the dock sections receive the ends of the flexible tieing elements. Stops located on the ends of the tieing elements engage the pads so that adjacent dock sections cannot be separated from one another without compressing the pads and thereby creating a compressibly yieldable restraint against the separation of the dock sections and preventing their being separated from one another past a predetermined limit. An elastomeric spacer located between adjacent dock sections provides a compressibly yieldable restraint against moving the dock sections toward one another and prevents them from coming closer to one another than a predetermined amount. Inserts fit between the stops and the ends of the cavities to prevent adjacent dock sections from hitting one another if the spacer becomes worn or is dislodged. A line-up sleeve located in the center of the cable is engaged by counterbores formed in the pads and by the ends of the cavities to prevent lateral and vertical movement between adjacent dock sections.

6 Claims, 2 Drawing Sheets

FLOATING DOCK HAVING SHOCK-ABSORBING COUPLING

RELATED APPLICATIONS

This application is a continuation-in-part of application Ser. No. 07/232,296 filed Aug. 15, 1988, now U.S. Pat. No. 4,852,509, Aug. 1, 1989.

BACKGROUND AND SUMMARY OF THE INVENTION

This invention relates to multi-element floating docks, and in particular to such docks in which the dock sections are joined together with flexible shock-absorbing couplings.

It is a common practice to make docks for mooring boats and the like from a plurality of floating sections which are joined together end to end. These dock sections must be joined together in a manner which permits angular displacement between them in order to accommodate wave action and other movement of the dock. However, the dock sections must be prevented from moving laterally and vertically relative to one another in order to maintain alignment. In addition, while the amount of separation between the dock sections must vary somewhat if the dock sections are to accommodate wave action, the amount of this separation must be limited.

In the past dock sections have been joined together by spanning both sides of adjacent dock sections with elongate wood planks or whalers. Threaded rods are inserted through aligned openings in the dock sections and the whalers and nuts are secured to their ends to clamp the whalers to the dock sections. This system has several shortcomings which limit its usefulness. First, since the threaded rods extend through the entire dock sections they are unwieldly and subject to breakage. In addition, while wood whalers are somewhat flexible, they do not permit the unlimited rotational movement between adjacent dock sections which is necessary to accommodate heavy wave action. Furthermore, the nuts on the ends of the threaded rods must be tightened sufficiently to achieve proper clamping action and not work free and yet must not be overtightened to the point where they compromise the strength of the components. Accordingly, the people who install the nuts must be skilled, and even then some overtightening and undertightening will occur. Because the coupling elements are partially concealed by the dock sections it is difficult to inspect them for damage. Even more of a problem is that the marine environment in which docks of this type are used will cause the nuts to become rusted onto the threaded rods making them difficult to remove. A final shortcoming of this prior art system is that in order to use it to attach finger piers to a main dock section, flanges must be attached to the finger pier which increases the cost and requires the use of different coupling elements.

The subject invention overcomes the foregoing shortcomings and limitations of the prior art by using elongate, flexible, noncompressible tieing elements, such as cables, to couple adjacent dock sections together. The cables pass through openings in elastically compressible pads which are attached to the dock sections. The cables have stops located at each of their ends which engage the outer ends of the pads and prevent the cables from being pulled back out of the pads. Thus, the pads act as compressibly yieldable restraints against the separation of the dock sections and prevent their separation past a predetermined point. An elastically compressible spacer which fits between adjacent dock sections serves as a compressibly yieldable restraint against movement of the dock sections toward one another and prevents their being moved closer together than a predetermined amount.

In a preferred embodiment of the invention the pads are placed in steel-lined cavities which are formed in the top surfaces of adjacent dock sections, which generally are made from reinforced concrete. This permits the steel liners to be welded to the reinforcing bar in the dock sections which spreads the load carried by the coupling elements over a wide portion of the dock sections. The pads are separated into top and bottom portions which have semispherical grooves in their mating surfaces which receive the cables. Thus, the bottom portion of a pad can be positioned in the cavity, the cable placed on top of it, and then the top portion of the pad installed over the top of the cable.

Inserts are inserted between the stops and the end walls of the cavities to prevent the adjacent dock sections from striking one another if the spacer which is placed between the dock sections becomes worn or is dislodged.

A line-up sleeve, which is attached to each cable intermediate its ends, fits into counterbores located in the ends of the pads and in openings formed in the end walls of the cavity. Thus, the line-up sleeve prevents lateral and vertical movement of the joined dock sections relative to one another without limiting the rotational movement necessary to accommodate wave action.

Accordingly, it is a principal object of the present invention to provide a multi-element floating dock having shock-absorbing flexible couplings which can be installed easily and quickly.

It is a further object of the present invention to provide such a dock in which the coupling elements are readily accessible for inspection.

It is a still further object of the present invention to provide such a dock in which the coupling elements are pretensioned automatically upon installation without the requirement of manual adjustment.

It is a still further object of the present invention to provide such a dock in which the coupling elements can be replaced easily without the necessity of loosening threaded connectors.

It is a yet a further object of the present invention to provide such a dock in which the same coupling components can be used for attaching main dock sections together and for attaching finger piers to the main dock sections.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 2:
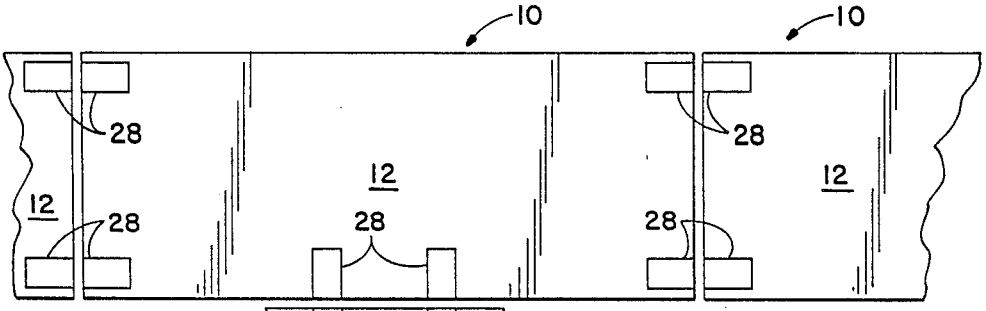
FIG. 2 is a plan view of the dock.
Figure 1:
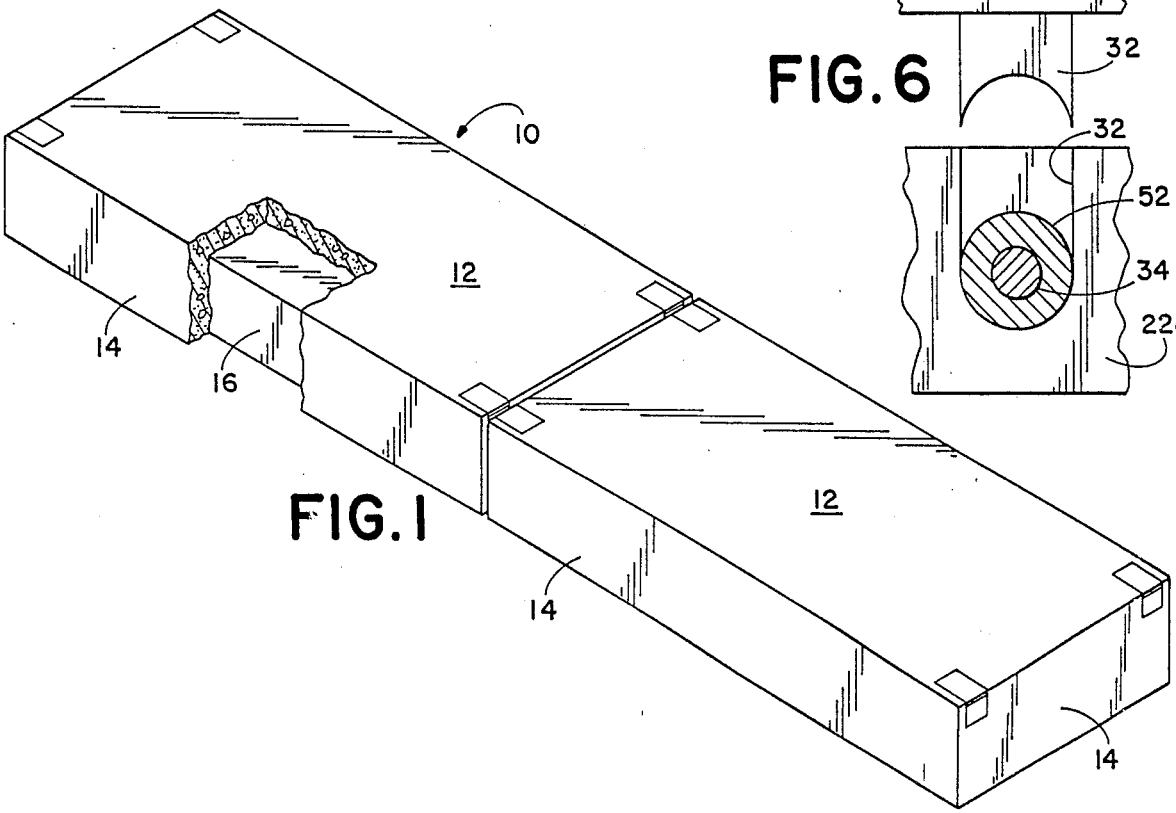
FIG. 1 is a perspective view, partially broken away to show hidden detail, of a multi-element floating dock embodying the present invention.

Referring to FIGS. 1 and 2 of the drawings, docks, such as used for mooring boats, often are constructed from a plurality of floating dock sections 10 which are tied together end to end. In addition, smaller dock sections 10*a* are attached to and extend out from the main dock sections to create finger piers to which the boats can be tied. The dock sections generally comprise inverted concrete shells having planar horizontal tops 12 and vertical side walls 14 which depend from the periphery of the tops. Styrofoam blocks 16 are placed under the shells to increase their buoyancy.

Figure 4:
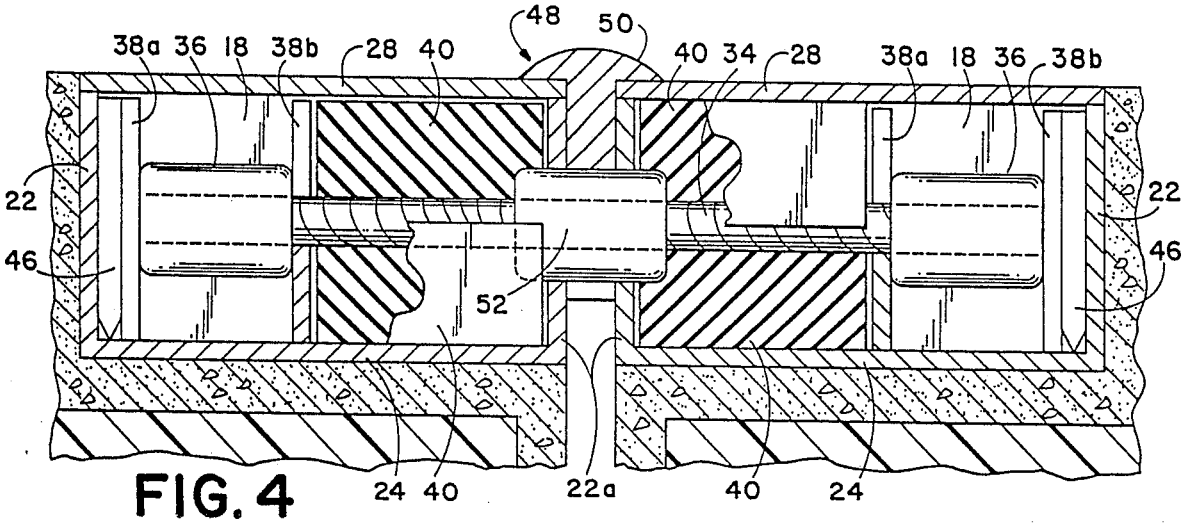
FIG. 4 is a sectional view taken along the line 4—4 of FIG. 3.
Figure 3:
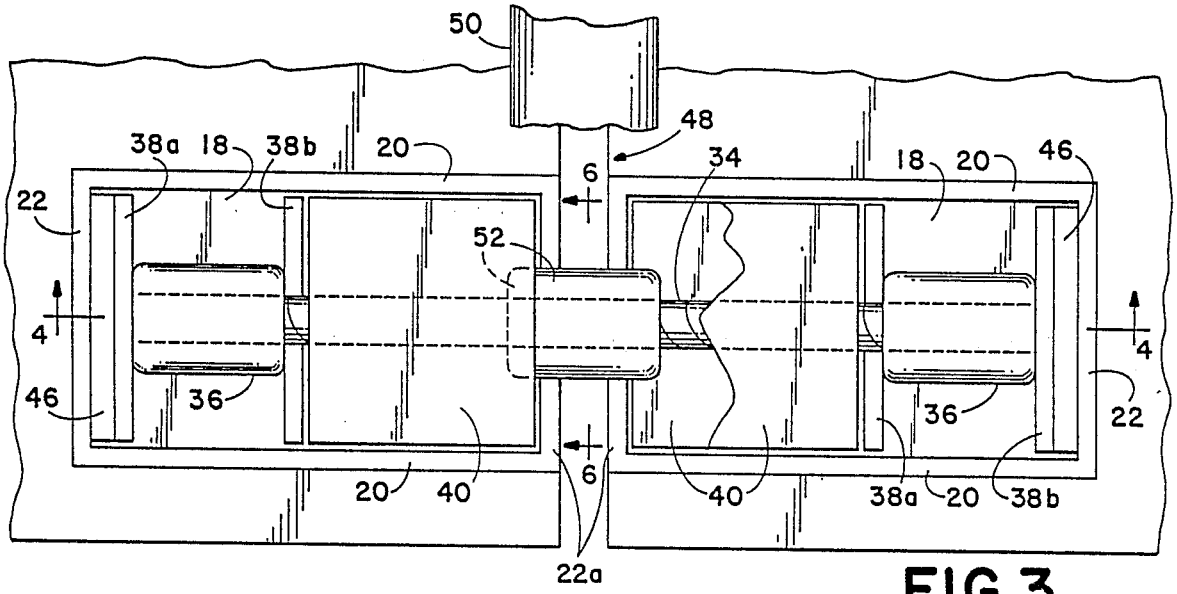
FIG. 3 is a fragmentary plan view, partially broken away to show hidden detail, at an enlarged scale showing that portion of the dock containing the elements which are used to couple adjacent dock sections together.
Figure 5:
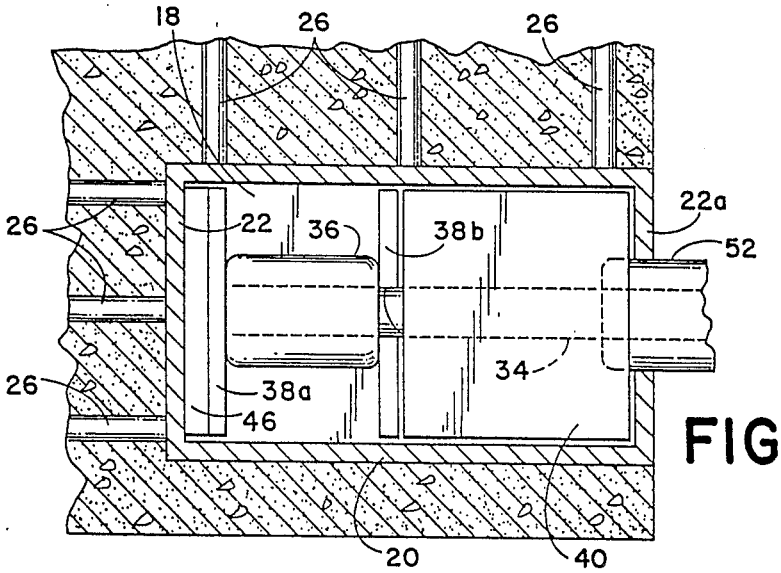
FIG. 5 is a sectional view, looking from above, showing details of a dock section.

Referring now also to FIGS. 3 and 4, the dock sections have cavities 18 formed in their tops which carry the coupling elements which tie adjacent dock sections together. These cavities are located in each dock section next to the side wall which will abut the side wall of the adjacent dock section, and the cavities in adjacent dock sections are arranged in pairs which are aligned with one another. The cavities are lined with steel side walls 20, end walls 22, and bottom walls 24, with the outside end walls 22*a* preferably replacing a portion of the concrete side wall 14. The cavity walls do not extend completely to the top surface of the dock section but are recessed from it by a distance equal to the thickness of the cavity walls. The cavity walls preferably are cast into the dock section when it is formed in order to create an integral unit. In addition, referring to FIG. 5, the cavity walls are welded to the reinforcing bar 26 which is embedded in the concrete of the dock section thereby spreading the loads which act on the cavity walls through a large portion of the dock section.

Figure 6:
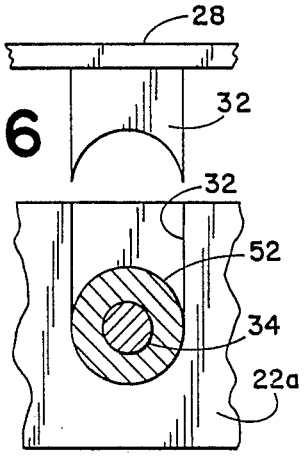
FIG. 6 is a sectional view taking along the line 6—6 in FIG. 3.

The cavities are covered by access plates 28 which fit into the recess which is formed above the cavity walls. Referring now to FIG. 6, a slot 30, having an arcuate lower extremity is located in the top portion of each outside end wall 22*a*. A tab 32 which depends from one edge of each access plate fills the upper portion of the slot 30 when the access plate is placed over the cavity. The bottom of the tab 32 also is arcuate so that a circular opening is formed between the end wall and the tab.

Figure 7:
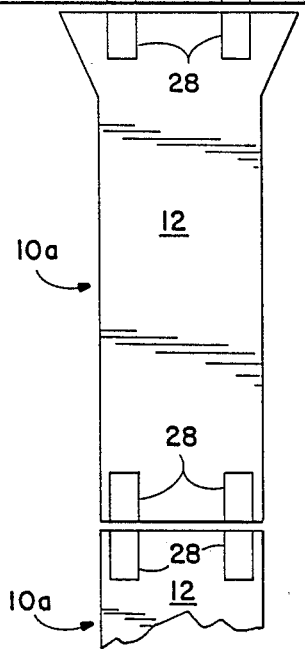
FIG. 7 is a perspective view of a pad which is an element of the invention.
Figure 7:
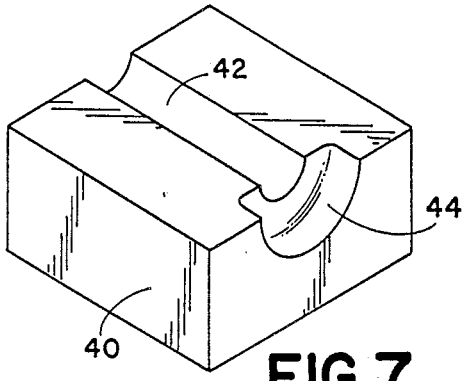

Adjacent dock sections are connected to one another by elongate flexible tieing elements, such as cables 34, which fit into and are retained by the cavities 18. Each cable 34 has a sleeve 36 attached to each of its ends and stop plates 38 are attached to both sides of each sleeve. The stop plates 38 are rectangular and are dimensioned to fit snugly within the cavities 18. When it is placed in a cavity, the portion of the cable 34 which extends between the inner stop 38*b* and the end wall 22*a* is enclosed with an elastomeric pad 40. The pad 40 substantially fills the cavity and is divided into top and bottom portions. Thus, the bottom portion can be placed into the cavity first, the cable can then be placed into the bottom portion of the pad, and the top portion can then be placed on top of the cable. As can be seen in FIG. 7, the pad portions have semi-cylindrical grooves 42 formed in them which form a cylindrical opening for the cable when the pad portions are brought together. At one end of the pads the grooves are enlarged to form a larger diameter counterbore 44, whose use will be described later.

The length of the cable between the two inner stops 38*b* is greater than double the length of the pads by an amount which is equal to the desired distance between the adjacent pair of dock sections which are tied together by the cable. If the dock sections are forced further apart the inner stops engage the pads and cause them to become compressed. Thus, the pads act as yieldable restraints against further separation of the dock sections up to a point where the pads become totally compressed and no further separation is possible.

After the cable and pads have been inserted into the cavities, an extruded elastomeric spacer 48, having a width which is greater than the distance between the dock sections, is inserted between the adjacent dock sections. The spacer acts as a yieldable restraint against movement of the dock sections toward one another and prevents them from becoming closer together than a predetermined distance. The spacer has a rounded cap 50 which smoothes the transition between the top surfaces of the dock sections. The width of the spacer is slightly greater than the normal space between the dock sections. In order to separate the dock and permit the spacer 48 to be inseted between them, a wedge (not shown) which is slightly wider than the spacer, is driven between the adjacent dock sections. As the wedge forces the dock sections apart, the inner stops 38*a* will cause the pads 40 to be compressed. When the spacer is inserted and the wedge removed the compressed pads will expand slightly and compress the spacer. Thus, both the pads 40 and spacer 48 are precompressed and there is no free movement of the dock sections relative to one another. Movement of the dock sections toward one another is always yieldably resisted by the spacer 48 and movement of the dock sections away from one another is always yieldably resisted by the pads 40.

The length of the sleeve 36 is such that when the cable is installed in the cavities and the pads and spacer are precompressed there is a gap between the end wall 22 of each cavity and the associated outer stop 38*a*. Inserts 46 having a width slightly less than this gap are inserted into the gap. These inserts will continue to maintain the precompression in the pads and will prevent the dock sections from striking each other in the event the spacer 46 is dislodged or wears due to the continual movement between the dock sections.

A line-up sleeve 52, similar to sleeves 36, is attached to the cable 34 intermediate its ends. The line-up sleeve 52 has the same diameter as the opening formed between the tabs 32 and the end walls 22*a*, and the counterbore 44 formed in the end of the pads. Thus, the line-up sleeve is engaged snugly by the pads and the end wall to prevent lateral and vertical movement of a dock section relative to the dock section to which it is attached. However, the flexible nature of the cable permits angular movement of the dock sections relative to one another in order to accommodate wave action on the dock.

When assembled the joint between the dock sections permits a predetermined amount of variation in either direction from the nominal amount of separation and yet does not permit movement past these predetermined limits. In addition, the dock sections are maintained in lateral and vertical alignment relative to one another at all times and yet angular movement is permitted to accommodate wave action. Furthermore, it is easy to inspect the joint elements to determine if they are damaged or have become worn beyond acceptable limits merely by lifting the access plates 28 off of the cavities.

Due to the fact that there are no elements which need to be tightened, the joint is easy to construct and the proper level of pretensioning is achieved automatically based on the size of the components. In addition, the lack of movable elements makes the joint easy to replace and rusting of the joint components will not impede their replacement. Finally, the joint components which attach main dock sections together can also be used to attach finger piers to the main dock sections.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A multi-element floating structure comprising:

(a) two or more floating dock sections which are positioned in end-to-end adjacency relative to one another;

(b) each of said dock sections having one or more cavities defined in the top surfaces thereof, one of said cavities being located proximate to and aligned with a mating cavity in each adjacent dock section;

(c) one or more elongate, unitary non-compressible tieing elements having stop elements permanently attached thereto proximate each end thereof;

(d) said cavities opening out of the ends of said dock sections so that one of said tieing elements can be placed into a mating pair of cavities with one of the stops on said tieing element being located in each of the cavities in said pair; and (e) means for coupling each stop on said tieing elements to a respective dock section to prevent movement of said dock sections toward and away from one another.

2. The structure of claim 1 wherein said cavities are defined in the side surfaces of said dock section.

3. The structure of claim 1 wherein said means for coupling includes:

(a) first elastically compressible means associated with each of said dock sections in said adjacent pair and with said stops for exerting a compressibly yieldable restraint against the separation of the dock sections in said adjacent pair relative to one another, and for preventing the dock sections in said adjacent pair from becoming separated from one another by more than a first predetermined distance; and (b) second elastically compressible means located between said adjacent pair of dock sections for exerting a compressibly yieldable restraint against the movement of the dock sections in said adjacent pair toward one another and preventing the dock sections in said adjacent pair from becoming closer than second predetermined distance to one another.

4. A multi-element floating structure comprising:

(a) two or more floating dock sections which are positioned in end-to-end adjacency relative to one another;

(b) each of said dock sections having cavities defined in the top surfaces thereof, with each cavity in every dock section being located proximate to and aligned with a mating cavity in an adjacent dock section;

(c) elongate tieing elements which extend between mating cavities in adjacent dock sections, said tieing elements having stops located proximate each end thereof;

(d) elastically compressible means associated with each of said dock sections in said adjacent pair and with stops for exerting a compressibly yiledable restraint against the separation of the dock section in an adjacent pair relative to one another, and for preventing the dock sections of said adjacent pair from being separated from one another by more than a first predetermined distance; and (e) insert means located in said cavity for preventing separation between stops and said elastically compressible means in order to prevent said adjacent pair of dock sections from moving toward one another.

5. The structure of claim 4 wherein said elastically compressible means comprises elastomeric pads which fit into said cavities and have openings defined medially therethrough which receive said tieing element, and said pads and stops do not completely fill said cavities and said insert means comprises flat plates which in combination with said pads and said stops completely fill said cavities.

6. A multi-element floating structure comprising:

(a) two or more floating dock sections which are positioned in end-to-end adjacency relative to one another;

(b) each of said dock sections having one or more cavities in the top surfaces thereof, one of said cavities being located proximate to and aligned with a mating cavity in each adjacent dock section;

(c) one or more elongate, unitary noncompressible tieing elements having stop elements permanently attached thereto proximate each end thereof;

(d) said cavities opening out of the ends of said dock sections so that one of said tieing elements can be placed into a mating pair of cavities with one of the stops on said tieing element being located in each of the cavities in said pair;

(e) means for coupling each stop on said tieing elements to a respective dock section to prevent movement of said dock sections toward and away from one another; and (f) wherein said means for coupling includes tabs which enclose the ends of said cavities after said tieing elements have been placed in said cavities.

* * * * *

UNITED STATES PATENT AND TRADEMARK OFFICE

CERTIFICATE OF CORRECTION

PATENT NO. : 4,962,716

DATED : October 16, 1990

INVENTOR(S) : Sig T. Fransen, et al.

It is certified that error appears in the above-identified patent and that said Letters Patent is hereby corrected as shown below:

Col. 6, Line 20: Change "yiledable" to --yieldable--.

Signed and Sealed this

Seventh Day of July, 1992

*Attest:*

DOUGLAS B. COMER

*Attesting Officer*

*Acting Commissioner of Patents and Trademarks*